United States Patent [19]

Stamp

[11] Patent Number: 4,884,395

[45] Date of Patent: Dec. 5, 1989

[54] FIBRE OPENING DEVICES

[75] Inventor: John J. Stamp, Simpsonville, S.C.

[73] Assignee: Wm. R. Stewart & Sons (Hacklemakers) Ltd., England

[21] Appl. No.: 209,729

[22] Filed: Jun. 22, 1988

[51] Int. Cl.[4] ..... D01H 7/892; D01H 7/895

[52] U.S. Cl. ..... 57/301; 19/97; 19/200

[58] Field of Search ..... 57/301, 408; 19/97, 19/112, 205, 200

[56] References Cited

U.S. PATENT DOCUMENTS

| | | | |
|---|---|---|---|
| 2,893,064 | 7/1959 | Rusca et al. | 19/97 X |
| 3,210,923 | 10/1965 | Schlosser | 57/408 |
| 4,512,060 | 4/1985 | Shofner . | |
| 4,631,781 | 12/1986 | Shofner . | |
| 4,686,744 | 8/1987 | Shofner | 19/200 |

FOREIGN PATENT DOCUMENTS

| | | |
|---|---|---|
| 1111549 | 7/1961 | Fed. Rep. of Germany . |
| 959560 | 6/1964 | United Kingdom . |
| 980989 | 1/1965 | United Kingdom . |
| 1449466 | 9/1976 | United Kingdom . |

OTHER PUBLICATIONS

Wilkinson & Moss, "Current Technology in Carding and Sliver Preparation", Clemson University, 1977.

*Primary Examiner*—Donald Watkins

*Attorney, Agent, or Firm*—Cushman, Darby & Cushman

[57] ABSTRACT

A fibre opening device for use in apparatus for spinning fibres into yarns comprising a housing in which an opening roller is rotatably mounted, the housing having a trash separation zone and a fibre stripping zone and the roller having a cylindrical working surface from which combing elements project and being substantially hollow with holes extending through the wall defining the cylindrical working surface to permit a flow of air therethrough, wherein cleaning means are provided for the interior of the roller, the cleaning means consisting of a vacuum suction device and a compressed air jet device which remove trash, dust and short fibres from the interior of the roller. It is preferred that the air jet device is in front of the suction device relative to the rotation of the roller and on the side of the roller remote from where combing of fibres occurs.

11 Claims, 1 Drawing Sheet

FIBRE OPENING DEVICES

Figure 1:
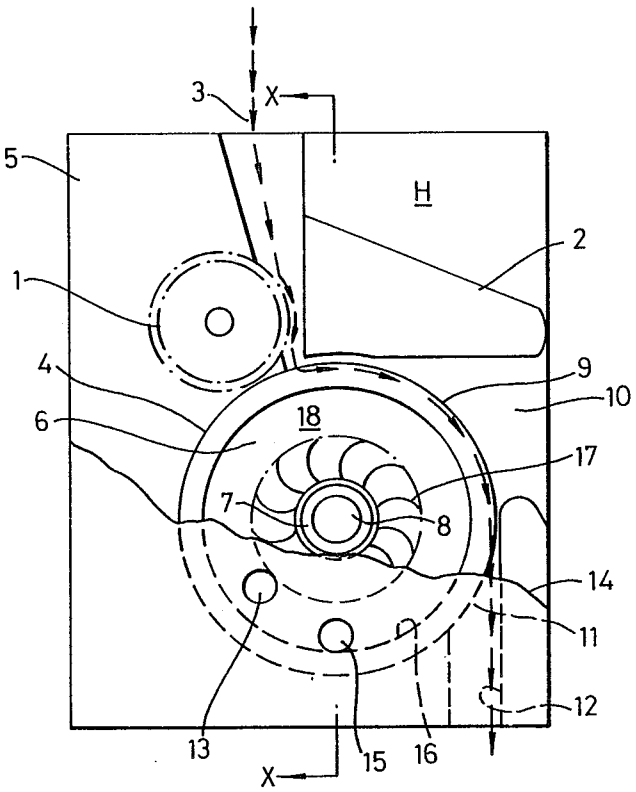

This invention relates to fibre opening devices having cleaning means for use in apparatus for spinning fibres into yarns using discontinuous processes.

An open end spinning process involves presenting a sliver of fibres to an opening device which may consist of a conventional drafting system or incorporate an opening roller with points or combing elements which may be integral with the working surface of the opening roller or be attached to the surface, as for instance pins or card wire.

In the second case, the combing action of the points separates the individual fibres and also serves to liberate any adherant dust or trash from the fibres.

A trash removal zone with or without one or more stripping edges may be provided to allow denser trash-particles to be separated from the fibre stream by centrifugal action.

The individual, separated fibres are carried forward by the points of the opening roller and are stripped from the roller in a second zone with a further stripping edge where a fibre transfer tube serves to transport the individualised fibres to a yarn assembly device which may be a rotor or a friction roller device.

Conventionally, the transport of the fibres is further assisted by keeping the yarn assembly device at a lower pressure than that at the opening device.

Opening devices with facilities for separating trash can be open or closed. Open trash separation devices are kept open to the surrounding atmosphere with a separate mechanical or aspiration facility to remove the trash which accumulates, while closed devices are subjected to a separate source of suction or pressure to separate and/or remove the trash.

In either case, the pressure at the opening device is usually kept higher than the pressure at the spinning device.

Rollers with pins, card wire or other forms of carding which also have perforations in the cylindrical wall defining the working surface and connecting to the interior of the roller are known in the field of fibre processing. The use of a roller with such perforations adapted as an opening roller for an open end spinning machine has surprisingly been found radically to improve the quality and regularity of the resultant spun yarn. It has been shown that there is an inflow of air into the interior of the opening roller with a consequent entrainment of lighter trash and dust, because trash and dust is deposited in the inside of the roller. The inflow of air and hence trash, dust and short fibres may, at least in part, be due to a build up of pressure generated at the trash separation zone by the pressure of the stripping edge at the stripping zone. Some stripping edges produce a greater pressure build up than others. This contributes, to some extent, to the resultant improvement in the cleanliness of the yarn because of the reduction in the amount of trash carried forward into the yarn forming device but it is known that the build up of dust and trash inside the roller reduces this improvement in yarn quality over a period.

According to the present invention, we provide a fibre opening device for use with a discontinuous spinning process comprising a housing in which an opening roller is rotatably mounted, the housing having a trash separation zone and a fibre stripping zone, wherein the roller has a cylindrical wall defining a working surface from which combing elements project, the roller being substantially hollow, and wherein holes are provided in the cylindrical wall of the opening roller to permit a flow of air through the surface of the roller to the hollow interior thereof, and including cleaning means consisting of a vacuum suction device and a compressed air jet device for removing the accumulated dust, trash and short fibre from the interior of the opening roller.

The preferred position of the air jet is in front of the suction device, as seen in the direction of rotation of the opening roller, and in a sector of the roller remote from where combing of fibres is taking place.

The vacuum suction device and air jet may be operated automatically at the same time or the vacuum device may operate continuously and the air jet intermittently. The air jet releases the trash, dust and short fibres which adhere to the interior of the roller allowing them to be sucked away by the vacuum device in close proximity to it.

The vacuum device may be a simple hole in a cover plate for an aperture in which the roller is located in the housing which is connected to a suction device or it may be a nozzle projecting into the hollow interior of the opening roller. The nozzle may have a single opening in the end or it may have one or more slots extending along part or all of its inserted length.

The air jet device may similarly be a simple hole in the cover plate or it may be a nozzle projecting into the hollow interior of the opening roller. In either case, it is connected to a source of compressed air with or without interruption means. The removal of the trash, dust and short fibres which would otherwise build up within the interior of the opening roller is found greatly to improve the CV% (evenness) and the Count Strength Product of the resultant yarn because otherwise the material which collects is initially carried forward through the perforations and incorporated into the yarn and ultimately the material will build up and block the perforations thus interrupting the flow of air through the opening roller. In either case, the yarn quality is found to be degraded.

The roller may also incorporate paddles or vanes on the inside back face to promote turbulence within the hollow interior of the roller and improve the agitation of the trash, dust and short fibre which would otherwise be deposited there, allowing it to be more easily released.

Figure 2:
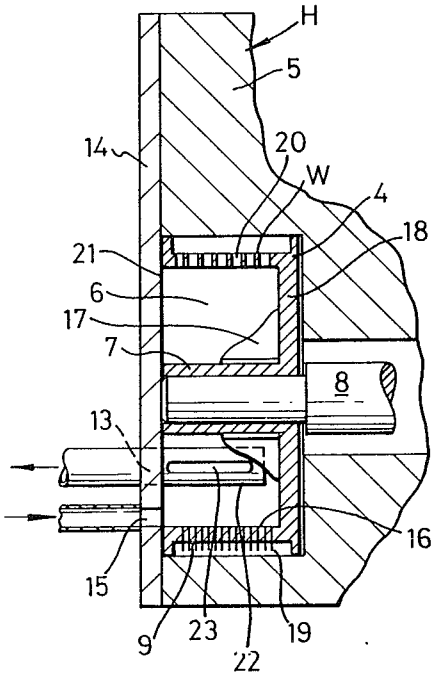

A preferred embodiment of fibre opening device according to the invention is now described, by way of example, with reference to the accompanying drawings, in which:

FIG. 1 is a scrap view of the fibre opening device for a discontinuous spinning process, and FIG. 2 is a section on the line X—X of FIG. 1 of the said fibre opening device.

Referring to the drawings, FIG. 1 shows a fibre opening device 5 for a discontinuous spinning unit comprising a feed roller 1 co-operating with a feed pedal 2 which presents a sliver of fibres 3 to an opening roller 4 which is rotatably mounted in a housing H forming part of the opening device 5 of the said spinning unit.

As can be seen from FIG. 2, the opening roller 4 has a hollow interior 6 defined by a hub 7 by means of which the roller is mounted on a rotatable shaft 8, a cylindrical wall W and an integral radial end wall 18 connecting the hub 7 to the wall W which is concentric with the hub 7, and the external face of which defines a cylindrical working surface 9. The open face 21 of the roller opposite wall 18 is closed off by a cover plate 14 connected to the housing H.

A trash separation zone 10 in the opening device 5 is defined in part by a portion of the circumferential working surface 9 of the opening roller 4 and a fibre stripping zone 11 is provided some distance further around the circumferential working surface 9 of the opening roller 4. The trash separation zone 10 is open to the atmosphere while the fibre stripping zone 11 is connected by a fibre transfer tube 12 to a fibre assembly device (not shown) which is held at a lower pressure by internal or external pumping means (not shown).

The individual fibres opened by the pinned roller 4 are transported circumferentially by the circumferential working surface 9 and stripped from pins mounted thereon in the fibre stripping zone 11. From there they are transported into the yarn assembly device (not shown) through the fibre transfer tube 12 by means of the airflow induced by internal or external pumping means (not shown).

Means for generating a vacuum (not shown) are connected to a hole 13 in the cover plate 14. The hole 13 may in turn be connected to a nozzle 22 projecting into the interior 6 of the opening roller 4. The nozzle 22 may have a single opening in the end or it may have one or more slots 23 extending along part or all of its inserted length.

Means (not shown) for supplying compressed air are connected to a second hole 15 forming an air jet in the cover plate 14. The hole 15 forming the air jet is positioned in front of the hole 13 forming or attached to the suction device, as seen in the direction of rotation of the roller 4. The two holes 13 and 15 form a cleaning means and are positioned in the cover plate 14 at some distance away from the trash separation zone 10 and the fibre stripping zone 11, i.e. on the side of the roller 4 where no combing is taking place.

Means (not shown) are provided to operate the vacuum and air jet automatically as necessary to release and remove the trash, dust and short fibres which would otherwise adhere to the interior surface 16 of the circumferential wall W of the opening roller 4. The roller 4 also incorporates fixed inclined vanes 17 between the hub 7 and the integral radial end wall 18 further to cause turbulence within the hollow interior 14 of the roller 4 and promote the agitation of the trash, dust and short fibre allowing it to be released more easily. These, however, are not essential.

The opening roller 4 has pins 19 projecting from its working surface 9 (although it could be provided with card wire). It is further provided with holes 20 interspersed with the pins 19 extending through its cylindrical wall W communicating the working surface 9 with the hollow interior 6 of the roller 4 and permitting the free flow of air into and out of the interior of the roller 4. This air flow causes the trash, dust and short fibres to be carried through to the hollow interior of the roller as the fibres are combed from the sliver 3 and pass through the trash separation zone 10.

Throughout the specification, reference has been made to holes in the wall of the opening roller, and these have been specifically described as holes 20 which are distinct from the pins 19. It will be appreciated, however, that instead of locating round shanked pins 19 with a tight fit in round holes in the wall of the roller, and drilling separate holes 20, the pins could have shanks which do not match their locating holes in the wall of the roller, thus leaving one or more holes around the pin shanks. In this case, separate holes 20 may not be necessary, and the term holes should therefore be interpreted accordingly.

It will of course be understood that the present invention has been described above purely by way of example, and modifications of detail can be made within the scope of the invention.

I claim:

1. A fibre opening device for use with a discontinuous spinning process comprising a housing in which an opening roller is rotatably mounted, the housing having a trash separation zone and a fibre stripping zone, wherein the roller has a cylindrical wall defining a working surface from which combing elements project, the roller being substantially hollow, and wherein holes are provided in the cylindrical wall of the opening roller to permit a flow of air through the surface of the roller to the hollow interior thereof, and including cleaning means consisting of a vacuum suction device and a compressed air jet device for removing the accumulated dust, trash and short fibre from the interior of the opening roller.

2. A fibre opening device according to claim 1 wherein the air jet is in front of the suction device, as seen in the direction of rotation of the opening roller, and in a sector of the roller remote from where combing of fibres is taking place.

3. A fibre opening device according to claim 1 wherein the vacuum device comprises a simple hole in a cover plate for an aperture in which the roller is located in the housing which is connected to a suction device.

4. A fibre opening device according to claim 1 wherein the vacuum device comprises a nozzle projecting into the hollow interior of the opening roller and connected to a suction device.

5. A fibre opening device according to claim 4 wherein the nozzle has one or more slots extending along part or all of its inserted length.

6. A fibre opening device according to claim 1 wherein the air jet device is a simple hole in a cover plate for the aperture in which the roller is located.

7. A fibre opening device according to claim 1 wherein the air jet device is a nozzle projecting into the hollow interior of the opening roller.

8. A fibre opening device according to claim 1 wherein the roller incorporates paddles or vanes on its inside back face to promote turbulence within the hollow interior of the roller and improve the agitation of the trash, dust and short fibre which would otherwise be deposited there, allowing it to be more easily released.

9. A fibre opening device according to claim 1 or 2 further including means for automatically simultaneously operating the vacuum suction device and air jet.

10. A fibre opening device for use with a discontinuous spinning process comprising a housing in which an opening roller is rotatably mounted, the housing having a trash separation zone and a fibre stripping zone, wherein the roller has a cylindrical wall defining a working surface from which combing elements project, the roller being substantially hollow, and wherein holes are provided in the cylindrical wall of the opening roller to permit a flow of air through the surface of the roller to the hollow interior thereof, and including cleaning means consisting of a vacuum suction device and a compressed air jet device for removing the accumulated dust, trash and short fibre from the interior of the opening roller, means for continuously operating the vacuum device, and means for intermittently operating the air jet.

11. A fibre opening device according to claim 10 wherein the air jet is in front of the suction device, as seen in the direction of rotation of the opening roller, and in a sector of the roller remote from where combing of fibers is taking place.

* * * * *